US005165369A

United States Patent [19]

Rembold et al.

[11] Patent Number: 5,165,369

[45] Date of Patent: Nov. 24, 1992

[54] HYDRAULIC VALVE CONTROL APPARATUS FOR A MULTICYLINDER INTERNAL COMBUSTION ENGINE

[75] Inventors: Helmut Rembold, Stuttgart; Ernst Linder, Mühlacker, both of Fed. Rep. of Germany

[73] Assignee: Robert Bosch GmbH, Stuttgart, Fed. Rep. of Germany

[21] Appl. No.: 688,589

[22] PCT Filed: Oct. 26, 1990

[86] PCT No.: PCT/DE90/00820

§ 371 Date: Jun. 28, 1991

§ 102(e) Date: Jun. 28, 1991

[87] PCT Pub. No.: WO91/08380

PCT Pub. Date: Jun. 13, 1991

[30] Foreign Application Priority Data

Nov. 25, 1989 [DE] Fed. Rep. of Germany ..... 3939002

[51] Int. Cl.[5] ..... F01L 9/02; F01L 1/26; F02D 13/02

[52] U.S. Cl. ..... 123/90.12; 123/90.16

[58] Field of Search ..... 123/90.12, 90.13, 90.16, 123/90.15

[56] References Cited

U.S. PATENT DOCUMENTS

| | | | |
|---|---|---|---|
| 4,231,543 | 11/1980 | Zurner et al. | 123/90.12 |
| 4,466,390 | 8/1984 | Babitzka et al. | 123/90.12 |
| 4,671,221 | 6/1987 | Geringer et al. | 123/90.12 |
| 4,674,451 | 6/1987 | Rembold et al. | 123/90.12 |
| 4,696,265 | 9/1987 | Nohira | 123/90.12 |
| 4,716,863 | 1/1988 | Pruzan | 123/90.12 |
| 4,889,084 | 12/1989 | Rembold | 123/90.12 |
| 4,889,085 | 12/1989 | Yagi et al. | 123/90.12 |

FOREIGN PATENT DOCUMENTS

| | | | |
|---|---|---|---|
| 3807699 | 9/1989 | Fed. Rep. of Germany | 123/90.12 |

*Primary Examiner*—E. Rollins Cross
*Assistant Examiner*—Weilun Lo
*Attorney, Agent, or Firm*—Edwin E. Greigg; Ronald E. Greigg

[57] ABSTRACT

A hydraulic engine valve control having a reservoir chamber, which is assigned to a pressure chamber of a valve tappet and has a reservoir piston, which at the same time serves as a valve by which the reservoir chamber can be disconnected from the pressure chamber. The reservoir piston is displaceable out of its position of repose into its reservoir function by a hydraulic control device that cooperates with a magnet valve. In this process, it is also attained that a plurality of valve control units of one internal combustion engine can be controlled via a single magnet valve, if their various control times do not overlap.

27 Claims, 2 Drawing Sheets

HYDRAULIC VALVE CONTROL APPARATUS FOR A MULTICYLINDER INTERNAL COMBUSTION ENGINE

BACKGROUND OF THE INVENTION

The invention is based on a hydraulic valve control apparatus for an internal combustion engine.

In a known hydraulic valve control apparatus of this generic type (German Published, Non-Examined Patent Application 3 511 820), the pressure line is controlled via a 2/2-way valve; according to a special exemplary embodiment (FIGS. 8 and 9), the multiposition valve connects the pressure line to the pressure chamber of one valve tappet in one switching position, and in the other switching position connects it to the pressure chamber of a different valve tappet, using only a single fluid reservoir for both pressure chambers. Accordingly, for two engine inlet valves, there is one control position each of the magnet valve, and only one reservoir is used for both inlet valves. The precision of control, or in other words how accurately the opening time cross section of the engine valve sought can actually be attained depends, especially at high rpm, on how large the total oil volume is that has to be displaced back and forth during control is, and how many control conduits of corresponding control cross sections have oil flowing through them. The magnet valve is an especially critical factor in the expense and vulnerability to malfunction of a hydraulic valve control apparatus of this kind; with engines having a typical maximum rpm, the possible switching frequency of these magnet valves falls far short of being fully exploited.

It has also already been proposed, (German Patent 38 156 687), in a hydraulic valve control apparatus of this generic type, to embody the reservoir piston as a movable valve element; the face-end edge of the piston cooperates with a valve seat, as a result of which the communication between the pressure line and the reservoir chamber is controllable. The reservoir piston simultaneously serves as the armature of a magnet valve that is open when it is without current, so that when the magnet is excited, the pressure line is disconnected from the reservoir chamber. Although in this version a combination of a fluid reservoir and a magnet valve is disclosed, in which the same element serves as both a movable valve element of the magnet valve and as a reservoir piston, nevertheless this requires that one such magnet valve and reservoir unit must be available for each valve control unit.

ADVANTAGES OF THE INVENTION

The valve control apparatus according to the invention has an advantage over the prior art that to put the fluid reservoir into operation, or in other words to open the communication between the pressure line and the reservoir chamber, the reservoir piston need be displaced only slightly out of its position of repose. All possible control devices are conceivable for this kind of slight displacement. In any case, however, the reservoir piston is displaced farther only whenever an appropriate hydraulic pressure is present in the pressure chamber of the valve tappet; such a pressure can be present only if the drive cam is acting upon this valve tappet. Accordingly, in all valve control units in which the drive cam is not operative at a particular time, the displacement of the reservoir piston from its position of repose remains without any further effect. For this control, the bottom edge of the reservoir piston is preferably used, which cooperates with a fixed seat, so that in the position of repose, or outset position, of the reservoir piston the pressure conduit is radially defined by the jacket face of the reservoir piston, while the reservoir chamber is defined by the end face. To this end, an annular groove may be formed around the jacket face, for instance in the region of the seat, so that the pressure conduit discharges into this annular groove, as in the valve control apparatus already proposed earlier as discussed above. However, this "reservoir magnet valve" is open when without current, so that when the magnet is not excited, the pressure of the pressure chamber expanding from the reservoir chamber via the pressure conduit during the opening action of the drive cam displaces the reservoir piston, which also happens if there is a power failure. This is intended on the one hand to assure that the engine cannot race if the plug falls out at the magnet valve, but this is achieved at the cost of a considerable impairment in function, aside from the fact that this "reservoir magnet valve" has a very complicated structure. The valve control apparatus according to the invention, contrarily, enables decoupling of the actual control device from the high-pressure-loaded valve reservoir.

Instead of a seat control, a slide control of the reservoir piston can naturally be provided, in accordance with which the pressure conduit is not made to communicate with the reservoir chamber until a certain minimum travel of the reservoir piston has been accomplished.

In an advantageous embodiment of the invention, the reservoir piston is displaceable from its position of repose by means of a control piston; for its adjustment, which causes the displacement of the reservoir piston, the control piston can be acted upon by control fluid at low pressure in its work chamber, and this fluid can be delivered from a fluid source (motor oil circulation loop) to the work chamber via a control line, the control line being controllable by the magnet valve. The result is a clear separation between the high-pressure portion including the pressure chamber and reservoir chamber, on the one hand, and the low-pressure or control pressure having the work chamber and the control fluid. As a result, in principle, the magnet valve is acted upon now only by low hydraulic pressure, so that in the absence of oil compression more accurate control can still be maintained. Naturally a suitable adaptation is needed between the spring that loads the reservoir piston and the pressure of the fluid source or the diameter of the control piston, so that not until the control fluid acts upon the control piston can the reservoir piston be displaced out of its position of repose, whereupon it shifts from its valve element function to its reservoir function. By this decoupling of the two hydraulic circuits, it becomes possible without difficulty to actuate a plurality of control pistons, but at least two of them, via a single 2/2-way magnet valve, with a corresponding displacement of the associated reservoir pistons from the position of repose. Those reservoir pistons of which the associated pressure chamber is at the moment not at high pressure from the drive cam return to their outset position immediately after the reduction of the control pressure, driven by their reservoir spring. On the other hand, the reservoir piston that is acted upon by the high pressure in the pressure chamber of the associated valve tappet is displaced, counter to the force of the reservoir spring, by fluid positively displaced from the pressure chamber.

In a further advantageous embodiment of the invention, the control piston is additionally loaded in the direction of the reservoir piston by a spring. Although this is a relatively weak spring, it nevertheless assures that there is a positive connection by shape between the reservoir piston and the control piston, in order to prevent one part from getting ahead of the other, which would cause a control error.

In a further advantageous feature of the invention, a radially sealingly guided pressure pin is used to transmit motion and force between the control piston and the reservoir piston. A pressure pin of this kind makes a largely free selection of the cross section of the control piston possible, so that despite the low pressure of the control fluid, adequate adjusting force for secure lifting of the reservoir piston from its position of repose is assured. Additionally, the frictional forces of a radial seal are lower with a pressure pin of this kind than with a control piston of relatively large diameter.

In another advantageous feature of the invention, which is also claimed separately and relates to a multicylinder engine, in which one valve control unit is assigned to each engine cylinder, a plurality of such pressure lines are each controlled simultaneously by only one magnet valve, by providing that only those valve control units in which there is no temporal overlap of their drive, effected by the engine camshaft with drive cams, are controlled by the magnet valve. Advantageously, with only one magnet valve, a plurality of pressure lines connecting the pressure chamber of the valve tappet to the applicable reservoir chamber can thus be controlled, thereby economizing on magnet valves that are not needed, and also lowering the vulnerability to malfunction. Moreover, the reservoirs can be disposed quite close to the valve tappets beside them, so as to keep both the control volume and the structural volume as small as possible. The association of one valve tappet with each reservoir piston, which is important for good precision of control, is advantageously attained.

In another advantageous feature of the invention, motor oil at feed pressure serves as the fluid source; it can be readily drawn from the motor oil circulation loop present in any engine, without requiring an additional pump. However, in multicylinder engines, an extra control oil circulation loop for the engine valve control may be provided instead of the motor oil circulation loop.

In another advantageous feature of the invention, the work chamber of the control piston is connected to the control line upstream of the magnet valve, and a throttle is present in the control line upstream of this connection. By means of this throttle, decoupling for the region between the throttle and the magnet valve is effected, so that when the magnet valve is opened the pressure in this intermediate segment drops to such an extent that the control piston or reservoir piston remains in its respective outset or repose position, loaded by the reservoir spring. In other words a kind of passive control is provided, in which an adjustment is effected only whenever the magnet valve is closed, resulting in a backup pressure in the control line.

In a further advantageous feature of the invention, the magnet valve is embodied as a 2/2-way valve. Depending on the use, such a valve may be embodied extremely simply, since absolute tightness is not necessary, and leaks do not cause problems as long as the quantity of oil flowing in again via the throttle maintains the backup pressure. The control fluid continuously flowing through when the magnet valve is opened causes uniform filling of all the chambers and thus a uniform replenishment of the fluid located in the control line.

In yet another advantageous feature of the invention, the work chamber of the control piston is connected to the control line downstream of the magnet valve. As a result, the pump for the control fluid is not loaded as severely, since only small quantities of fluid need to be replaced for the control process, namely the quantities that the control piston aspirates in its stroke. Furthermore, because of the relatively large cross sections that are possible, fast reaction in control piston actuation can also be attained.

In another advantageous feature of the invention, the magnet valve is embodied here as a 3/2-way valve. As a result, more-precise switching is attainable, and because of the small quantity of fluid to be moved for control purposes, work can for instance be done with a hydraulic reservoir.

In another advantageous embodiment of the invention, which relates to both the variants described above, the reservoir chamber communicates with the fluid source (motor oil circulation loop) of low pressure via a compensation line, in which a check valve opening in the direction of the reservoir chamber is disposed. As a result, as long as the reservoir piston is in its position of repose, a defined pilot pressure exists in the reservoir chamber, so as to keep the forces engaging the reservoir piston in its position of repose defined. An appropriate fill apparatus for the pressure conduit or pressure chamber is known per se.

Other advantages and advantageous features of the invention can be inferred from the ensuing description, the drawing, and the claims.

DRAWING

Two exemplary embodiments of the subject of the invention are shown in the drawing and described in detail below. Shown are:

FIG. 1, a longitudinal section through the valve control apparatus of a valve of the first exemplary embodiment;

FIG. 2, a corresponding detail of a valve control apparatus of a second exemplary embodiment; and FIG. 3, a control diagram of the valve control apparatus for a four-cylinder internal combustion engine.

DESCRIPTION OF THE EXEMPLARY EMBODIMENT

Figure 1:
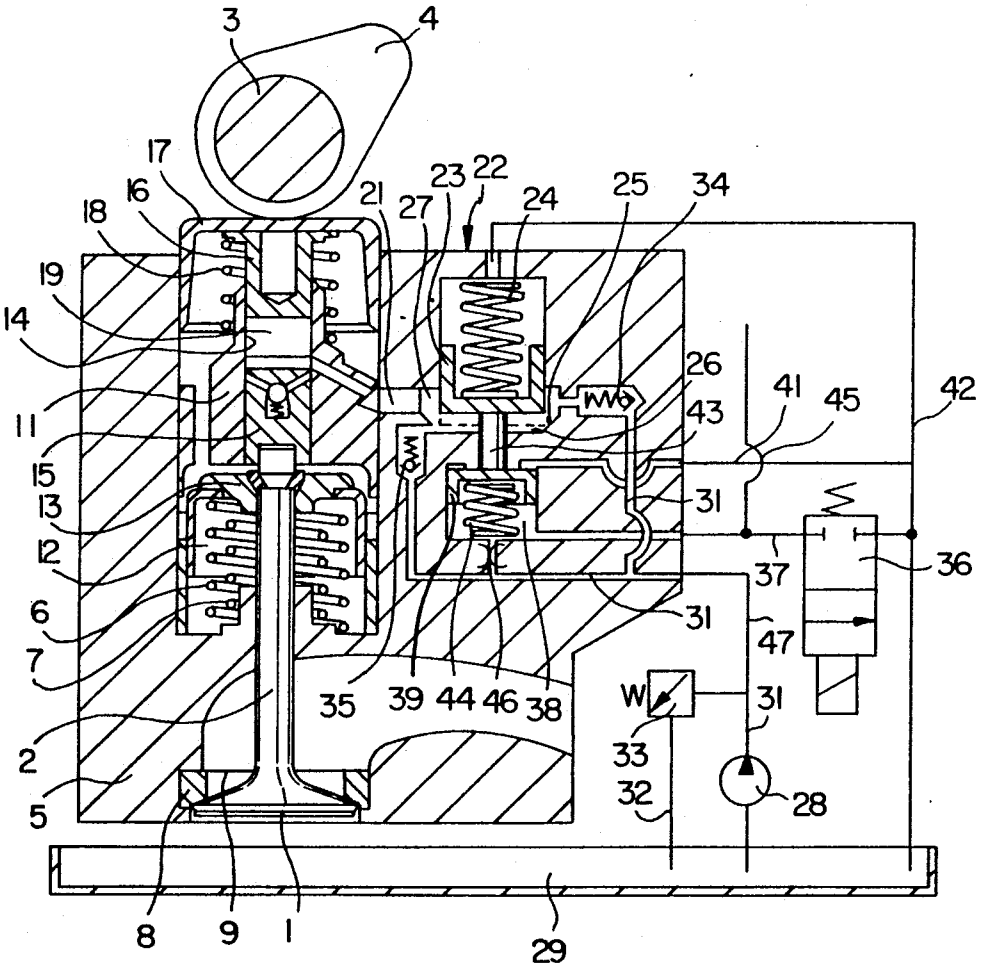

FIG. 1 shows a first exemplary embodiment of a hydraulic control apparatus according to the invention in longitudinal section and in the form of a hydraulic circuit diagram, the apparatus being disposed between a valve shaft 2 carrying a valve plate and a drive cam 4 that rotates with a camshaft 3. The valve shaft 2 is axially displaceably guided in a valve housing 5, and is loaded in the closing direction of the valve by coaxial valve closing springs 6 and 7, as a result of which the valve plate 1 is pressed against a valve seat 8 in the valve housing 5. The valve plate 1 controls a valve inlet opening 9, formed between it and the valve seat 8 when the valve is opened.

The hydraulic valve control apparatus has a control housing 11 inserted into the valve housing 5; a housing chamber and coaxially with it a spring chamber 12 are disposed in the control housing 11, and the valve closing springs 6 and 7 are accommodated coaxially with one another in the spring chamber 12. A cup-shaped spring plate 13, anchored with the valve shaft 2 and being both axially displaceable and loaded by the valve closing springs 6 and 7, is inserted into the control housing 11 from below. A valve piston 15 cooperating with the valve shaft 2 of the inlet valve is disposed in a central, axially continuous bore 14 of the control housing 11, and a work piston 16 of a cam piston 17 is disposed axially displaceable above the valve piston 15 in this bore. The work piston 16 is loaded by a restoring spring 18, which is supported at one end on the control housing 11 and on the other end engages a flange of the work piston 16 and thereby presses the cam piston 17 against the valve control cam 4.

An oil-filled pressure chamber 19 is enclosed between the end faces facing one another of the valve piston 15 and work piston 16 in the housing bore 14; the effective length of the entire valve tappet is determined by the quantity of oil present in the pressure chamber 19. If the quantity of oil is reduced, the effective opening stroke of the inlet valve is shorter; if maximum filling is maintained, its stroke is at a maximum.

The pressure chamber 19 communicates via a pressure conduit 21 with a reservoir valve 22 that has a radially sealing cup-shaped reservoir piston 23, which is loaded by a reservoir spring 24 and in its position of repose, shown in dashed lines, rests on a valve seat. The lower end face of the reservoir piston 23 defines a reservoir chamber 26; part of the jacket face of the reservoir piston 23 defines an annular conduit 27 surrounding that piston, into which conduit the pressure conduit 21 discharges.

The valve control apparatus operates with a hydraulic circulation loop having a feed pump 28 that aspirates the control oil from an oil tank 29 and delivers it to the control apparatus via a feed line 31. To attain a certain feed pressure, a pressure control valve 33 is disposed in a line 32 that branches off from the feed line 31 and leads back to the oil tank 29. The feed line 31 leads on the one hand to the annular conduit 27 or pressure conduit 21 and pressure chamber 19 and on the other to the reservoir chamber 26. Check valves 34 and 35 that open toward the annular conduit 27 and the reservoir chamber 26, respectively, are disposed in the two line segments.

The core of the control system is embodied by a 2/2-way magnet valve 36, with which a control line 37 is controlled that branches off from the feed line 31 and leads to a work chamber 38, in which a control piston 39 is acted upon radially sealingly and axially displaceably by the hydraulic pressure located in the control line 37. On the side remote from the work chamber 38, the control piston 39 is pressure-relieved via a relief conduit 41 to a return line 42 of the hydraulic circulation loop leading without pressure back to the oil tank 29. The control piston 39 is disposed coaxially with the reservoir piston 23, and a pressure pin 43 that is guided radially sealingly and axially displaceably in the housing is provided between the two end faces of the pistons oriented toward one another. So that there will be positive engagement between the pistons 23 and 39 via this pressure pin 43, the control piston 39 is urged by a spring 44 in the direction of the reservoir piston 23. This spring has only slight force and by itself is not capable of overcoming the force of the reservoir spring 24. Branching off from the control line 37 is a control line 45 that leads to a further valve control unit.

A throttle 46 is disposed in the control line 37, upstream of the work chambers 38 but downstream of the point at which the feed line 31 branches off. The control line 37 discharges downstream of the magnet valve 36 into the pressureless return line 42.

In accordance with the embodiment of the invention and the supply according to the invention of two valve control apparatus by one magnet valve, further feed lines 47 branch of from the feed line 31, leading on the one hand to the valve control apparatus controlled by the same magnet valve 36 and on the other supplying the remaining valve control apparatus of the engine with hydraulic oil.

Figure 2:
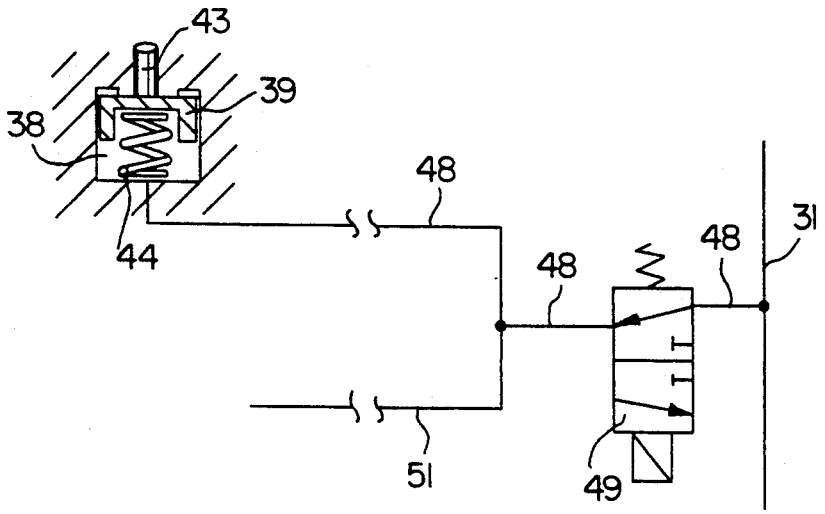

FIG. 2 shows the second exemplary embodiment, in which the entire valve control apparatus corresponds to that of the first exemplary embodiment, and in which only the actual control region, that is, the core of the invention, is embodied differently. In this second exemplary embodiment, the control line 48 branches off from the feed line 31 upstream of the magnet valve 9. The magnet valve is embodied as a 3/2-way magnet valve (that is, three connections and two positions). The control line 48, embodied here as a blind line, ends in the work chamber 38 of the control piston 39; the control piston 39, as in the first exemplary embodiment, is disposed between the pressure pin 43 and the spring 44. The second control line 51, which leads to the pressure chamber of a further valve control apparatus and is likewise embodied as a blind line, branches off from the control line 48.

The function of the hydraulic valve control according to the invention will be described below in conjunction with the diagram shown in FIG. 3. In this diagram, the opening stroke h of four inlet valves I, II, III and IV of a four-cylinder internal combustion engine is plotted over the crankshaft angle, °KW. The succession of ignition in this engine is one, three, four, two of the engine cylinders disposed side by side and having the inlet valves I–IV.

Figure 3:
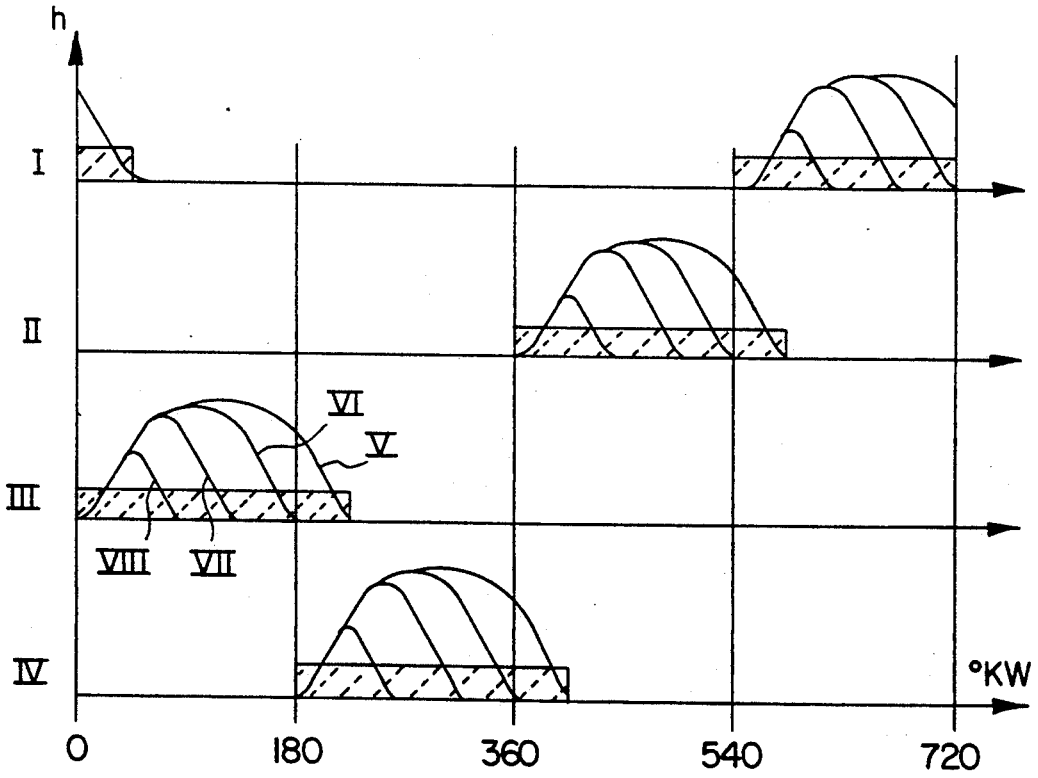

As can be seen from the four engine valve curves I–IV of FIG. 3, there is no direct ignition succession between the cylinders of the engine valves I and IV and those of engine valves III and II. As can be seen from the ordinate in FIG. 3, there is accordingly no overlap between the opening strokes of the engine valves associated with one another, that is, one and four, on the one hand, and two and three, on the other. In their maximum version, that is, the highest curve V, these valve control curves accordingly correspond to the cam course of the applicable drive cam 4; a corresponding cam is assigned to each inlet valve.

As shown in the diagram of FIG. 3, the starting point is a crankshaft angle of zero, when the cam of the engine valve III is just beginning its valve operation; this can then continue until closure of the valve at over 200° KW. At 180° KW, however, the control cam of the engine valve IV already begins to act upon the cam piston 17 assigned to it, so that here the inlet valve of cylinder IV already opens before the inlet valve of cylinder III is closed. The same is true for the control cam IV of engine valve II becoming operative beyond 360° KW and for the onset of opening of the engine valve I beyond 540° KW. Any interventions in the stroke of an inlet valve can thus never occur, except, as described above, when a valve control cam for actuating the valve is also acting upon the cam piston 17 assigned to it.

The applicable stroke control per inlet valve is represented for the valve control curves of FIG. 3 by the various curve families for four different desired control values at a time, per engine valve I–IV. As can be seen from FIG. 1, upon rotation of the camshaft 3 the control face of the valve control cam IV runs off the cam piston 17; this piston presses the work piston 16 downward counter to the force of the restoring spring 18 and in so doing, via the volume of oil enclosed in the pressure chamber 19, presses the valve piston 16, including the valve shaft 2 and the inlet valve plate 1, downward counter to the force of the valve closing spring 6 and 7, in the course of which the valve plate 1 lifts from the valve seat 8.

As long as the reservoir piston 23 is still in its position of repose on its seat 25, no oil can be positively displaced out of the pressure chamber 19. The pressure forces acting upon the jacket face of the reservoir piston 23 in the annular chamber 27 cancel one another out. No oil can flow out via the check valve 34. Accordingly, as long as this position is assumed, the inlet valve is maximally opened, which, as explained with the example of the engine valve III, is equivalent to the outer curve V of the valve control diagram. As soon as a shorter stroke, corresponding to a smaller time cross section of the valve opening 9, is to be established, the magnet valve 36 is blocked, as shown in FIG. 1, so that the hydraulic oil from the feed pump 28 and the feed line 31 can no longer flow through the control line 37 and the magnet valve 36 to the return line 42, but instead is blocked. Contrarily, as long as a flow through the system does take place, or in other words as long as the magnet valve 36 is open, a certain decoupling of the pressure in the feed line 31 or of the feed pump 28 toward the control chamber 38 is attained, so that no pressure required to adjust the control piston 39 can come about there. When the magnet valve 36 is blocked, contrarily, the action of the throttle 46 is cancelled because of the backup of fluid, resulting in the creation of a control pressure in the control chamber 38 by means of which the control piston 39, via the pressure pin 43 and the reservoir piston 23, is lifted from its seat 25 counter to the force of the spring 24, so that the reservoir chamber 26 communicates with the annular chamber 27. As a result, the oil pressure located in the pressure chamber 19 is transmitted to the reservoir chamber 26 via the pressure conduit 21. Not until the reservoir piston 23 lifts from the valve seat 25 can the reservoir accordingly become operative as such, whereupon the reservoir piston 23 is correspondingly displaceable counter to the reservoir spring 24.

If the lifting of the reservoir piston 23 from the valve seat 25 takes place at a time in which the valve control cam 4 is just then in action, and a relatively high pressure therefore exists in the pressure chamber 19, the further opening function of the inlet valve is ended thereby, because the oil continuing to be positively displaced by the work piston 16 is pumped via the pressure conduit 21 into the reservoir 26, with corresponding displacement of the reservoir piston 23 counter to the reservoir spring 24. FIG. 3, taking the example of the engine valve III, shows in curves VI, VII, VIII how large the actual remaining opening cross section per °KW can be. The later the magnet valve 36 is blocked during the opening stroke of the engine valve, the larger is the total opening time cross section per inlet valve; the area located underneath the curve is equivalent to the effective opening time cross section. While in curve VIII not only the valve stroke h is especially short, the duration in °KW until closure of the valve, or in other words until the valve closing springs 6 and 7 have finally pressed the valve plate 1 fully onto the valve seat 8, is also relatively short.

In the exemplary embodiment shown in FIG. 2, this control process, namely a reduction of the opening time cross section is attained by opening the magnet valve 49. Not until the backup pressure is established in the control line 48, after closure of the magnet valve 49, is the control piston 39 displaced and effects the appropriate lifting of the reservoir piston 23 from the valve seat 25.

Because, in the control of the various inlet valves in multicylinder internal combustion engines, inlet valves of the type are present in which the control time, from the standpoint of the valve control cam, cannot overlap with that of others (as described above), such valve control units can each be triggered via only one magnet valve. Control lines 45 and 51 then correspondingly branching off from the control lines 37 and 48 then lead to these control units, which are not operative simultaneously. That is, as soon as the magnet valve 36 blocks at approximately 90° KW in the case of the engine valve III, this results in a valve control corresponding to curve VI. The branching control line 45, which as described above leads to the valve control unit of engine valve II, transmits this backup pressure from the control line 37 to the control piston 39 present at the engine valve II, and this piston likewise effects a displacement of the reservoir piston 23 out of its position of repose. However, since for the engine valve II the associated drive cam 4 is inoperative, or the pitch circle of this cam is just then cooperating with the cam piston 17, this control has no effect whatever on the actual control of this valve, which does not begin until 360° KW. However, the magnet valve 36 must open and close twice as often than if it had to control only a single valve control unit.

Naturally this combination of the control of a plurality of valve control units with only one magnet valve is correspondingly also possible in internal combustion engines having a higher number of cylinders. The definitive factor is that it is always engine control units of the kind in which the various control times do not overlap that are controlled by only a single magnet valve.

All the characteristics disclosed in the description and in the following claims and shown in the drawing may be essential to the invention either individually or in any arbitrary combination with one another.

We claim:

1. A hydraulic valve control apparatus for an internal combustion engine, having an engine valve axially driven by an engine camshaft via a valve tappet, an oil-filled pressure chamber of variable volume that determines the effective length of the valve tappet, one fluid reservoir each connectable to the pressure chamber via a pressure conduit, and a magnet valve for controlling the pressure conduit, the reservoir is embodied as a spring-loaded piston reservoir, a reservoir piston on its face end defines a reservoir chamber and as a movable valve element establishes a communication between the pressure conduit and the reservoir chamber as soon as the reservoir piston is displaced out of a position of repose, wherein the reservoir piston is displaceable out of its position of repose by means of an adjustable control piston; that for its displacement this control piston can be acted upon by a control fluid at low pressure in its work chamber, which fluid can be delivered to the work chamber from a fluid source via a control line; and that the control line is controllable by means of the magnet valve.

2. A valve control apparatus as defined by claim 1, in which the control piston (39) is additionally loaded by a spring (44) in a direction of the reservoir piston (23).

3. A valve control apparatus as defined by claim 1, in which a radially sealingly guided pressure pin (43) serves to transmit motion and force between the control piston (39) and the reservoir piston (23).

4. A valve control apparatus ad defined by claim 2, in which a radially sealingly guided pressure pin (43) serves to transmit motion and force between the control piston (39) and the reservoir piston (23).

5. A valve control apparatus as defined by claim 1, which comprises a multicylinder internal combustion engine, in which one valve control unit is assigned to each engine cylinder, in which a plurality of such pressure conduits (21) are simultaneously controlled by only one magnet valve (36, 49), and a drive which includes a camshaft (3) with a plurality of drive cams (4) has no temporal overlap.

6. A valve control apparatus as defined by claim 2, which comprises a multicylinder internal combustion engine, in which one valve control unit is assigned to each engine cylinder, in which a plurality of such pressure conduits (21) are simultaneously controlled by only one magnet valve (36, 49), and a drive which includes a camshaft (3) with a plurality of drive cams (4) has no temporal overlap.

7. A valve control apparatus as defined by claim 3, which comprises a multicylinder internal combustion engine, in which one valve control unit is assigned to each engine cylinder, in which a plurality of such pressure conduits (21) are simultaneously controlled by only one magnet valve (36, 49), and a drive which includes a camshaft (3) with a plurality of drive cams (4) has no temporal overlap.

8. A valve control apparatus as defined by claim 4, which comprises a multicylinder internal combustion engine, in which one valve control unit is assigned to each engine cylinder, in which a plurality of such pressure conduits (21) are simultaneously controlled by only one magnet vale (36, 49), and a drive which includes a camshaft (3) with a plurality of drive cams (4) has no temporal overlap.

9. A valve control apparatus as defined by claim 1, in which motor oil at feed pressure serves as the fluid source (28).

10. A valve control apparatus as defined by claim 1, in which the work chamber (38) of the control piston (39) is connected to the control line (37) upstream of the magnet valve (36), and that upstream of this connection there is a throttle (46) in the control line (37).

11. A valve control apparatus as defined by claim 2, in which the work chamber (38) of the control piston (39) is connected to the control line (37) upstream of the magnet valve (36), and that upstream of this connection there is a throttle (46) in the control line (37).

12. A valve control apparatus as defied by claim 3, in which the work chamber (38) of the control piston (39) is connected to the control line (37) upstream of the magnet valve (36), and that upstream of this connection there is a throttle (46) in the control line (37).

13. A valve control apparatus as defined by claim 5, in which the work chamber (38) of the control piston (39) is connected to the control line (37) upstream of the magnet valve (36), and that upstream of this connection there is a throttle (46) in the control line (37).

14. A valve control apparatus as defined by claim 1, in which the work chamber (38) of the control piston (39) is connected to the control line (37) upstream of the magnet valve (36), and that upstream of this connection there is a throttle (46) in the control line (37).

15. A valve control apparatus as defined by claim 10, in which the magnet valve (36) is embodied as a 2/2-way valve.

16. A vale control apparatus as defined by claim 1, in which the work chamber (38) of the control piston (39) is connected to the control line (48) downstream of the magnet valve (49).

17. A valve control apparatus as defined by claim 2, in which the work chamber (38) of the control piston (39) is connected to the control line (48) downstream of the magnet valve (49).

18. A valve control apparatus as defined by claim 3, in which the work chamber (38) of the control piston (39) is connected to the control line (48) downstream of the magnet valve (49).

19. A valve control apparatus as defined by claim 5, in which the work chamber (38) of the control piston (39) is connected to the control line (48) downstream of the magnet valve (49).

20. A valve control apparatus as defined by claim 9, in which the work chamber (38) of the control piston (39) is connected to the control line (48) downstream of the magnet valve (49).

21. A valve control apparatus as defined by claim 16, in which the magnet valve (49) is embodied as a 3/2-way valve (49).

22. A valve control apparatus as defined by claim 1, in which the reservoir chamber (26) communicates with the fluid source (28) of low pressure via a compensation line (31), and that a check valve (35) opening in the direction of the reservoir chamber (26) is disposed in the compensation line (31).

23. A valve control apparatus as defined by claim 2, in which the reservoir chamber (26) communicates with the fluid source (28) of low pressure via a compensation line (31), and that a check valve (35) opening in the direction of the reservoir chamber (26) is disposed in the compensation line (31).

24. A valve control apparatus as defined by claim 3, in which the reservoir chamber (26) communicates with the fluid source (28) of low pressure via a compensation line (31), and that a check valve (35) opening in the direction of the reservoir chamber (26) is disposed in the compensation line (31).

25. A valve control apparatus as defined by claim 5, in which the reservoir chamber (26) communicates with the fluid source (28) of low pressure via a compensation line ()31), and that a check valve (35) opening in the direction of the reservoir chamber (26) is disposed in the compensation line (31).

26. A valve control apparatus as defined by claim 9, in which the reservoir chamber (26) communicates with the fluid source (28) of low pressure via a compensation line (31), and that a check valve (35) opening in the direction of the reservoir chamber (26) is disposed in the compensation line (31).

27. A valve control apparatus as defined by claim 22, in which the reservoir chamber (26) communicates with the fluid source (28) of low pressure via a compensation line (31), and that a check valve (35) opening in the direction of the reservoir chamber (26) is disposed in the compensation line (31).

* * * * *